US011528558B2

(12) United States Patent
Grimanis

(10) Patent No.: US 11,528,558 B2
(45) Date of Patent: Dec. 13, 2022

(54) METHOD AND AN AUDIO PROCESSING UNIT FOR DETECTING A TONE

(71) Applicant: Tymphany Acoustic Technology Limited, Taipei (TW)

(72) Inventor: Dimitrios Grimanis, Taipei (TW)

(73) Assignee: TYMPHANY ACOUSTIC TECHNOLOGY LIMITED, Taipei (TW)

( * ) Notice: Subject to any disclaimer, the term of this patent is extended or adjusted under 35 U.S.C. 154(b) by 0 days.

(21) Appl. No.: 17/173,846

(22) Filed: Feb. 11, 2021

(65) Prior Publication Data

US 2021/0249028 A1 Aug. 12, 2021

Related U.S. Application Data

(60) Provisional application No. 62/972,894, filed on Feb. 11, 2020.

(51) Int. Cl.

| | |
|---|---|
| ***H04R 5/04*** | (2006.01) |
| ***G10L 21/0216*** | (2013.01) |
| ***H04R 3/12*** | (2006.01) |

(52) U.S. Cl.

CPC ..... *H04R 5/04* (2013.01); *G10L 21/0216* (2013.01); *H04R 3/12* (2013.01); *G10L 2021/02163* (2013.01)

(58) Field of Classification Search

CPC ..... H04R 5/04; H04R 3/12; G10L 21/0216; G10L 2021/02163

USPC ..... 381/92

See application file for complete search history.

(56) References Cited

U.S. PATENT DOCUMENTS 5,442,712 A * 8/1995 Kawamura ..... H04R 3/02 381/83

* cited by examiner

*Primary Examiner* — Paul Kim

(74) *Attorney, Agent, or Firm* — Muncy, Geissler, Olds & Lowe, P.C.

(57) ABSTRACT

A method for detecting a prominent tone of an input audio includes establishing a first analysis audio signal based on the input audio signal, establishing a second analysis audio signal based on the input audio signal, wherein an analysis audio signal of the first analysis audio signal and the second analysis audio signal is established by applying an analysis audio filter to the input audio signal, comparing the first analysis audio signal and the second analysis audio signal to obtain an energy level contrast, and determining a representation of the prominent tone by converting the energy level contrast by a contrast-to-frequency mapping function.

19 Claims, 6 Drawing Sheets

| | |
|---|---|
| 2 | Audio signal input |
| 4a, b | Filtering unit |
| 6a, b | Level detector |
| 8a | Comparator |
| 10a | Frequency mapping unit |

| | |
|---|---|
| 2 | Audio signal input |
| 4a, b, c | Filtering unit |
| 6a, b | Level detector |
| 8a, b, c | Comparator |
| 10a, b, c | Frequency mapping unit |
| 13 | Averaging unit |

METHOD AND AN AUDIO PROCESSING UNIT FOR DETECTING A TONE

CROSS REFERENCE TO RELATED APPLICATIONS

The present application claims priority to U.S. provisional patent application No. 62/972,894, which was filed on Feb. 11, 2020, the entire contents of which are hereby incorporated by reference.

FIELD OF THE INVENTION

The present invention relates to a method for detecting a tone of an audio signal. The invention further relates to an audio processing unit for detecting a tone of an audio signal and use of an audio processing unit.

BACKGROUND OF THE INVENTION

Various approaches exist for detecting tones or a prominent tone of an audio signal. One example is to use a frequency counter, which may simply count the number of cycles of oscillations within a fixed period of time. This approach is however susceptible to errors, e.g. if a first overtone is present in the signal the frequency counter may detect twice as many oscillations. Another approach is to use a spectrum analyzer, which may for example be based on performing a Fourier transformation of the audio signal. However, such analysis may be relatively slow and/or may require a large degree of computational power. A third approach is to use many separate bandpass filters for isolating many individual frequency segments, which in turn may require an extensive number of components or an extensive amount of processing power to be implemented.

SUMMARY OF THE INVENTION

The inventors have identified the above-mentioned problems and challenges related to detecting a tone of an audio signal, and subsequently made the below-described invention which may improve such detection.

The invention relates to a method for detecting a prominent tone of an input audio signal, said method comprising the steps of: establishing a first analysis audio signal based on said input audio signal; establishing a second analysis audio signal based on said input audio signal, wherein an analysis audio signal of said first analysis audio signal and said second analysis audio signal is established by applying an analysis audio filter to said input audio signal; comparing said first analysis audio signal and said second analysis audio signal to obtain an energy level contrast; and determining a representation of said prominent tone by converting said energy level contrast by a contrast-to-frequency mapping function.

In an exemplary embodiment of the invention, an audio processing unit facilitates the method of the invention. An input audio signal is provided, which is dominated by a single prominent tone. It may for example be an audio signal from a musical instrument playing a single musical tone. A first analysis audio filter and a second analysis audio filter are applied to that input audio signal to generate a first analysis audio signal and a second analysis audio signal. The first audio filter is a bandpass filter centered at 40 Hz, and the second audio filter is a bandpass filter centered at 80 Hz. If the prominent tone lies at approximately 40 Hz, the first filter will not substantially attenuate the input audio signal to generate the first analysis audio signal, but the second bandpass filter will substantially attenuate the input audio signal, e.g. by 20 dB, to generate the second analysis audio signal. Similarly, if the prominent tone lies at approximately 80 Hz, the first audio filter will substantially attenuate the input audio signal to generate the first analysis audio signal, but the second audio filter will not substantially attenuate the input audio signal to generate the second analysis audio signal. Generally, if the prominent tone lies anywhere between the center frequencies of the two filters, the first and second analysis audio signals will in combination contain a unique relative attenuation of the input audio signal. This unique relationship between the frequency and relative attenuation can be analyzed to obtain a representation of the prominent tone. The first analysis audio signal and the second analysis audio signal are compared to obtain an energy level contrast which is indicative of the relative attenuation. This may for example be implemented simply by measuring an energy level of the first audio signal and an energy level of the second audio signal and subtracting these to obtain the difference between their energy levels. The energy level contrast can then be converted to a representation of the prominent tone by a contrast-to-frequency mapping function, which preferably is indicative of the relationship between the relative attenuation and frequency of the prominent tone. The representation of the prominent tone may for example be indicative of a frequency of the prominent tone. It may alternatively just be a binary signal e.g., a signal indicative of whether or not a prominent tone within a certain frequency interval is present in the input audio signal.

The invention thus allows detection of a prominent tone of an input audio signal. In the prior art, various other approaches for detection of a prominent tone exist. In comparison, the invention may provide a representation of a prominent tone which may be less susceptible to errors, independent of volume of input audio signal, faster, cheaper to implement, easier to implement, and/or which may require less computational power. Some of these advantages, or other advantages, may be achieved to different extent and in different combinations by various embodiments of the present invention.

The invention is thus useful in applications where detecting a prominent tone is required, for example for tuning musical instruments, detecting audio feedback such as undesired audio feedback, and general audio analysis. Audio feedback may also be referred to as acoustic feedback or the Larsen effect. However, note that the invention is not restricted to any particular applications.

BRIEF DESCRIPTION OF THE DRAWINGS

Various embodiments of the invention will in the following be described with reference to the drawings where.

DETAILED DESCRIPTION

Figure 1A:
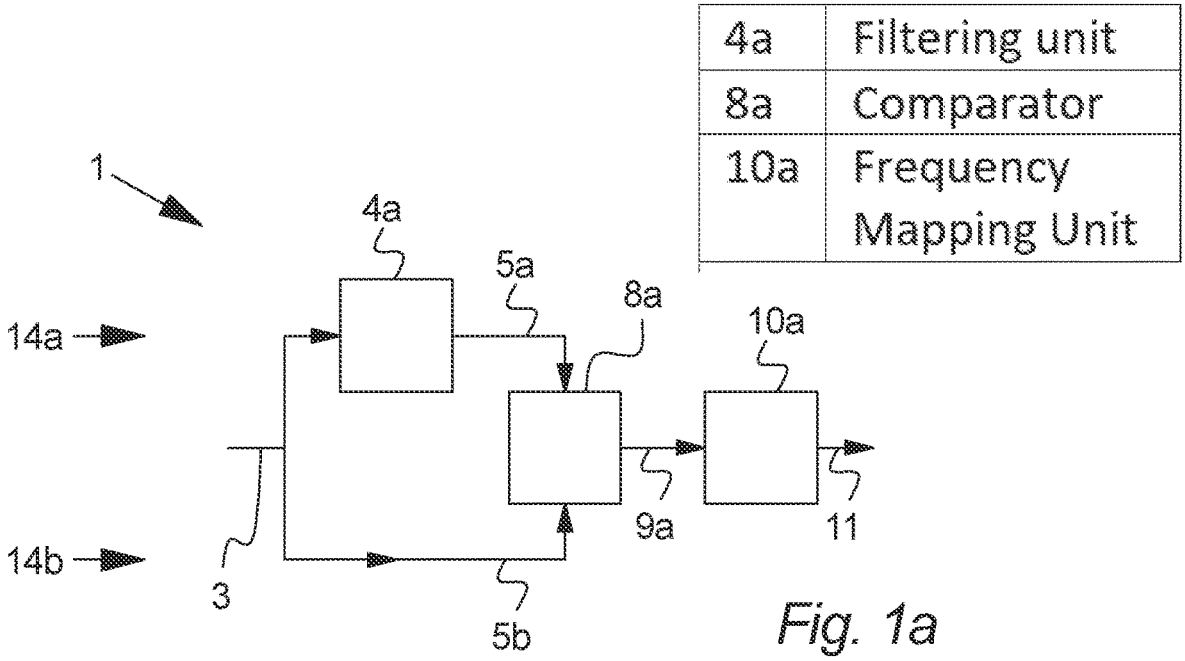
FIGS. 1*a-b* illustrate an embodiment of the invention and an associated visual representation of an analysis audio filter of that embodiment.

In the following, various concepts of the invention are presented without reference to particular embodiments.

An input audio signal is a type of audio signal, which may for example be understood as a type of digital or analog signal representing audible sound. The audio input signal may for example be suitable for being supplied to a loudspeaker, optionally with one or more intermediate steps of amplification, conversion (e.g., digital-to-analog), or other processing. The input audio signal may for example be supplied through an audio signal input, e.g., a wired or wireless connection to an audio signal source. The input audio signal may also for example be provided via a microphone recording a sound upon which the input audio signal is based, or via a digital storage.

A typical audio signal may be composed of several frequencies. This may for example be evident through a Fourier transformation of the signal. A prominent tone may be understood as a frequency component of an audio signal, in which that frequency component is at least partly distinguishable from other frequencies of that audio signal, e.g., because of a higher amplitude. One example of an audio signal with distinguishable frequencies is an audio signal based on playing a musical tone on a musical instrument. Such an audio signal may for example comprise both a natural/fundamental frequency as well as several harmonic frequencies, in which case the prominent tone will be the frequency component with the highest level within the frequency band analyzed. In case of resonance or constructive interference in an audio system, a prominent tone may occur at the resonance frequency, as for example when experiencing audio feedback. An audio signal consisting of a single tone is considered a prominent tone of such an audio signal. For audio signals comprising several frequency components, for example music, speech, most naturally occurring sounds, noise, etc., a specific frequency component may be considered a prominent tone when the level of that frequency component is at least partly distinguishable from other frequency components or background noise.

Some audio signals are composed of a continuum of frequencies which are dynamically changing in amplitude and phase. In such cases, a prominent tone may not be clearly distinguishable in the spectrum. In some embodiments of the invention, special care is taken to analyze such complex audio signals, e.g., by implementing additional filters, to nevertheless provide an accurate representation of the prominent tone. Generally, embodiments of the invention are not restricted to analyzing a particular type of audio signal or providing a particular type of representation of the prominent tone since a useful representation of a prominent tone may be extracted even from complex audio signals by utilizing suitable processing and analysis tools. However, to not obscure the description of the invention with unnecessary detail, the analysis of input audio signal will primarily be explained using simple audio signals as examples. Note further, that in some embodiments of the invention, a representation of a prominent tone may be provided independent of the complexity of the audio signal, but for sufficiently complex audio signals, accuracy or precision may be reduced.

A representation of a prominent tone, preferably by indication of a frequency or a tone name, may for example be a digital representation, an analogue representation, a visual indication, or actual sound waves.

An analysis audio filter may be understood as an audio filter which, for example, in turn may be a frequency dependent amplifier circuit, e.g., working in the audible frequency range, e.g., up to 20 kHz. An analysis audio filter may thus typically provide frequency-dependent amplification, attenuation, passage, and/or phase shift. An audio filter may for example be implemented as a digital circuit, an analog circuit, and/or programmed onto a programmable unit, such as a digital signal processor. Examples of audio filters are low-pass filters, high-pass filters, bandpass filters, and all-pass filters. An audio filter may be implemented in an audio filter unit, which may both be understood as a physical circuit, or a digitally programmed entity.

When an audio filter is applied to an audio signal, it may be interpreted as a generation of another audio signal, e.g., applying an analysis audio filter to an input audio signal may result in the generation of an analysis audio signal, e.g., a first or a second analysis audio signal. Although typically, at least one of the analysis audio filters are filtered, analysis audio signals are not restricted to filtered signals. E.g., one of the first and the second analysis audio signals may be a filtered signal, whilst the other is not.

An energy level contrast may be understood as a difference between the energy levels of two audio signals. An energy level of an audio signal may for example be an RMS average, a peak value, an average of the square of the audio signal, or an average of an envelope of the audio signal. An energy level of an audio signal may also be related to or indicative of a power level of the audio signal. Typically, an energy level may be indicative of the attenuation of an audio signal. For example, if an audio signal has been attenuated by an audio filter, its energy level is lower than if the audio signal has not been attenuated. An energy level may for example be quantified by dB, e.g., relative to some reference energy/intensity/audio volume.

The energy level contrast obtained by comparison of two audio signals may for example be obtained as a ratio or a subtraction between the energy levels of the two signals. The energy level contrast does not necessarily require explicitly calculating two energy levels but may for example be obtained through comparison of two audio signals. The energy level contrast may, for example, be obtained from the ratio of two audio signals. Alternatively, the energy level contrast may be obtained by explicitly calculating a (first) energy level of a first audio signal and a (second) energy level of a second audio signal. Detecting an energy level of an audio signal may for example be facilitated by a level detector. Obtaining an energy level contrast may for example be facilitated by an energy level comparator, which may for example use two audio signals or two energy levels as inputs.

A contrast-to-frequency mapping function may be understood as a physical or digital unit which is usable in converting an energy level contrast into a corresponding representation of the prominent tone. In typical embodiments of the invention, due to different analysis audio filters, the energy level contrast depends on the frequency of the prominent tone, at least in some frequency range. The contrast-to-frequency mapping function may be based on this dependency. The contrast-to-frequency mapping function may thus for example be a lookup table of a piecewise mathematical function. It may for example be implemented in a frequency mapping unit.

In some embodiments of the invention, a contrast-to-frequency mapping function may have several energy level contrasts as inputs, for example an energy level contrast from a first and a second analysis audio signal, and an energy level contrast from the second and a third analysis audio signal.

In the following, various embodiments of the invention are described with reference to the figures.

Figure 1B:
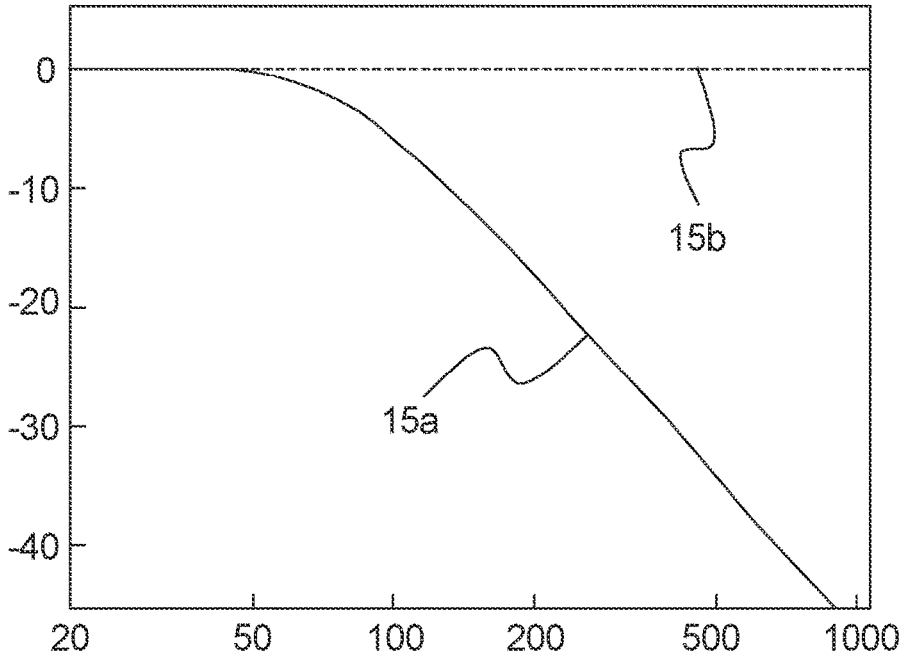

FIGS. 1*a-b* illustrate an embodiment of the invention and an associated visual representation of an analysis audio filter of that embodiment. Particularly, FIG. 1*a* illustrates a schematic illustration of the embodiment, while FIG. 1*b* illustrates the frequency-dependent effect of a filtering unit 4*a* of that embodiment to the energy of an audio signal.

The embodiment is an audio processing unit 1, for example an audio processing unit which is at least partly implemented using a digital signal processor. The audio processing unit 1 receives an input audio signal 3, for example from an audio signal input. In this exemplary description, the input audio signal 3 comprises a prominent tone.

This input audio signal is divided into two analysis paths; a first analysis audio channel 14*a* and a second analysis audio channel 14*b*. In the first analysis path, the input audio signal is provided to a filtering unit 4*a* which applies an analysis audio filter. In this exemplary embodiment, the filtering unit 4*a* is arranged to apply a lowpass filter to the input audio signal to establish a first analysis audio signal 5*a*. In the second analysis audio channel 14*b*, the input audio signal 3 serves as the second analysis audio signal 5*b*. The difference between the first analysis audio signal 5*a* and the second analysis audio signal 5*b* thus stems from the filtering which the signals have undergone.

The effect of the filter is detailed in FIG. 1*b*. The horizontal axis is a frequency axis in units of Hz, while the vertical axis is an energy level axis in units of dB. The frequency-dependent effect that the filtering unit 4*a* applies to an audio signal is illustrated as a first frequency representation of the energy level attenuation 15*a*. Since the filtering unit is a lowpass filter, it minimally attenuates signals at low frequencies below approximately 50 Hz. Frequencies above 50 Hz are however attenuated, and the larger the frequencies, the larger the attenuation. An input audio signal 3 which travels to the energy level comparator 8*a* via the first analysis audio channel 14*a* and the filtering unit 4*a* will thus be attenuated based on the frequency of that audio signal according to the illustrated first frequency representation of energy level attenuation 15*a*. In contrast, an input audio signal 3 which travels to the energy level comparator 8*a* via the second analysis audio channel 14*b* will not be attenuated. In other words, it will be attenuated according to the illustrated second frequency representation of energy level attenuation 15*b*, which is a frequency-independent line at 0 dB.

The first and the second analysis audio signals 5*a*, 5*b* are both supplied to an energy level comparator 8*a*, which is arranged to compare the two signals 5*a*, 5*b* to obtain an energy level contrast of the two signals. Generally, if the energy of the two signals is different, this may be indicated by the energy level contrast. The exact details depend on the type of filter and how exactly the energy level contrast is calculated, which vary between different embodiments.

In this embodiment, the ratio of the two analysis audio signals 5*a*, 5*b* is generated, and an RMS average of the resulting ratio is measured.

The obtained energy level contrast 9*a* is supplied to a frequency mapping unit 10*a*. Here, the energy level contrast 9*a* is converted via a contrast-to-frequency mapping function into a representation of the prominent tone 11, e.g., a frequency representation of the prominent tone. The contrast-to-frequency mapping function may typically be preprogrammed and based on the choice of filters for the embodiment. It may for example be based on a diagram similar to the one illustrated in FIG. 1*b*. It should preferably be able to convert a supplied contrast into a corresponding frequency, e.g., via a lookup table or a mathematical function.

The embodiment is thus able to analyze a supplied input audio signal into a representation of the prominent tone 11.

If, for example, an input audio signal 3 is dominated by a prominent tone at a frequency of approximately 100 Hz, the first analysis audio signal 5*a* is attenuated by approximately 6 dB compared to the input audio signal 3. The second analysis audio signal 5*b* is not attenuated, and its difference to the input audio signal is thus 0 dB. The energy level comparator 8*a* compares the energy levels of the two signals 5*a*, 5*b* and obtains an energy level contrast 9*a* of approximately 6 dB. This energy level contrast 9*a* is supplied to the frequency mapping unit 10*a* which converts the contrast 9*a* into a frequency representation of the prominent tone via a lookup table. This lookup table indicates that an energy level contrast of approximately 6 dB must correspond to a frequency of the prominent tone of approximately 100 Hz. The representation of the prominent tone 11 may thus, for example, be a digital or analog representation of 100 Hz which is supplied to a user or to further audio analysis. Note that in this case if the audio volume of the input audio signal is changed, the obtained energy level contrast and hence the representation of the prominent tone is largely unaffected.

If, for example, an input audio signal is dominated by a prominent tone at a frequency of approximately 200 Hz, the analysis procedure is similar with a difference of energy levels of approximately 17 dB instead, which the frequency mapping unit is able to convert into a representation of approximately 200 Hz.

Note that this concrete embodiment is limited to the extent that frequencies below approximately 50 Hz experience approximately the same attenuation, and accordingly, this attenuation cannot be mapped accurately into a frequency. Furthermore, at sufficiently large frequencies and sufficiently low volume of the input audio signal, the input audio signal 3 may be attenuated by the filtering unit 4*a* to such a degree that it is not possible to obtain an energy level contrast 9*a* which is truly indicative of the frequency due to a poor signal-to-noise ratio of the analysis audio signal. This embodiment is thus primarily accurate for prominent tone from approximately 50 Hz to approximately 500 Hz, depending on the volume of the input audio signal 3. However, note that filter types and configurations may be varied within the scope of the invention, which may for example result on other frequency limits, or even no frequency limits (e.g., by implementing a large number of unique filters covering all frequencies). Thus, the invention is not limited to any particular frequency ranges.

Figure 2:
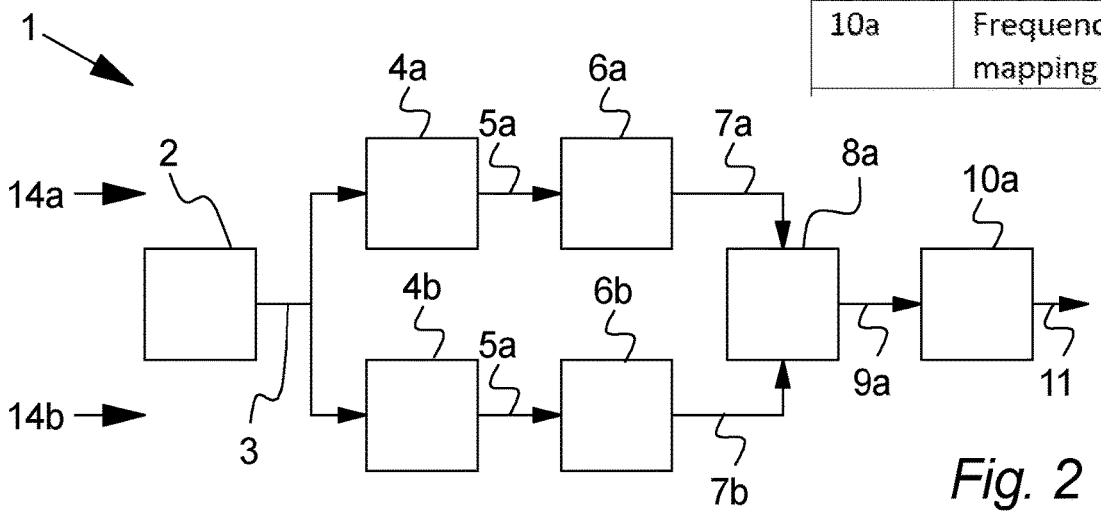
FIG. 2 illustrates an embodiment of the invention based on two analysis audio filters.

FIG. 2 illustrates an embodiment of the invention based on two analysis audio filters 4*a*, 4*b*. In comparison with the embodiment illustrated in FIG. 1*a*, the embodiment illustrated in FIG. 2 further comprises a second filtering unit 4*b*, such that the first analysis audio channel 14*a* has a first filtering unit 4*a*, and the second analysis audio channel 14*b* as a second filtering unit 14*b*. Further, the embodiment has a first level detector 6*a* between the first filtering unit 4*a* and the energy level comparator 8*a* as part of the first analysis audio channel 14*a*, and a second level detector 6*b* between the second filtering unit 4*b* and the energy level comparator 8*a* as part of the second analysis audio channel 14*b*. Furthermore, the embodiment has an explicit audio signal input 2 for providing the input audio signal 3. Generally, the audio signal input 2 may for example be a wired connection, a wireless connection, a microphone, or a data storage. In this embodiment, the input 2 is based on a microphone.

In this embodiment, the input audio signal 3 is thus separately filtered through a first filtering unit 4*a* and a second filtering unit 4*b*. The two filtering units 4*a*, 4*b* are different in the sense that they apply different analysis audio filters. They may for example both apply bandpass filters with the same quality factor but with different filter center frequencies.

Applying two separate filters to the input audio signal 3 broadens the flexibility of the method. For example, two separate filers may be implemented to improve precision, accuracy, or a frequency range in which the method is able to provide an accurate representation of the prominent tone.

Supplying the input audio signal 3 to the first filtering unit 4*a* establishes the first analysis audio signal 5*a*, and similarly, supplying the input audio signal 3 to the second filtering unit 4*b* establishes the second analysis audio signal 5*b*. The first and the second analysis audio signals 5*a*, 5*b* are supplied to a first level detector 6*a* and a second level detector 6*b*, respectively. Each of these level detectors 6*a*, 6*b* are able to measure a supplied analysis audio signal to detect an energy level of that signal. Thus, the two level detectors 6*a*, 6*b* measure the analysis audio signals 5*a*, 5*b* to provide two separate energy levels 7*a*, 7*b*.

The two energy levels 7*a*, 7*b* are supplied to the energy level comparator, which compares the levels 7*a*, 7*b* to obtain an energy level contrast 9*a*. For example, if the first energy level is approximately −7 dB and the second energy level is approximately −15 dB, the energy level difference may approximately by 8 dB.

As previously explained, when an obtained energy level contrast 9*a* has been obtained, it may be converted by a frequency mapping unit 10*a* to determine a representation of the prominent tone 11.

Figure 3:
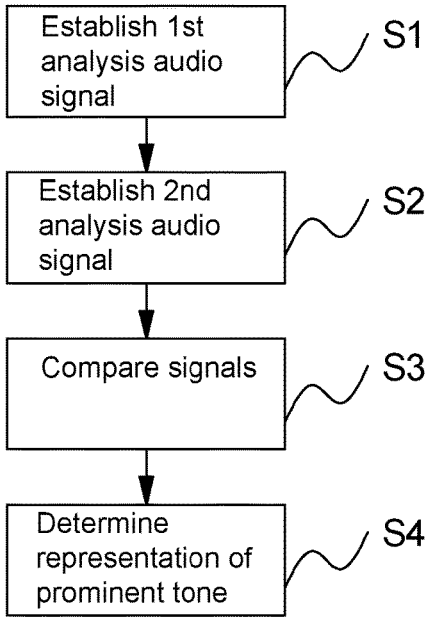
FIG. 3 illustrates a visual representation of method steps according to an embodiment of the invention.

FIG. 3 illustrates a visual representation of method steps according to an embodiment of the invention. This embodiment of the invention is able to detect a prominent tone of an input audio signal and comprises four method steps S1-S4. However, note that embodiments of the invention are not restricted to these particular method steps.

In a first step S1, a first analysis audio signal is established based on the input audio signal.

In a next step S2, a second analysis audio signal is established based on the input audio signal. A signal of the first analysis signal and the second analysis signal is established by applying an analysis audio filter to the input audio signal. The other signal may for example be the input audio signal. For example, the first analysis audio signal may be established by applying the analysis audio filter to the input audio signal, while the second analysis audio signal is the input audio signal. Or, for example, the second analysis audio signal may be established by applying the analysis audio filter to the input audio signal, while the first analysis audio signal is the input audio signal.

Even though the two steps S1, S2 of establishing first and second analysis audio signals are presented as separate steps, they may for example be executed in parallel.

As a next step, the first analysis audio signal and the second analysis audio signal are compared to obtain an energy level contrast.

As a next step, a representation of the prominent tone is determined by converting the energy level contrast by a contrast-to-frequency mapping function.

In some embodiments of the invention, the method is implemented on a circuit or a processor which continuously performs the steps of the method repeatedly. Any of the steps may be performed, at least partly, in parallel.

Figure 4:
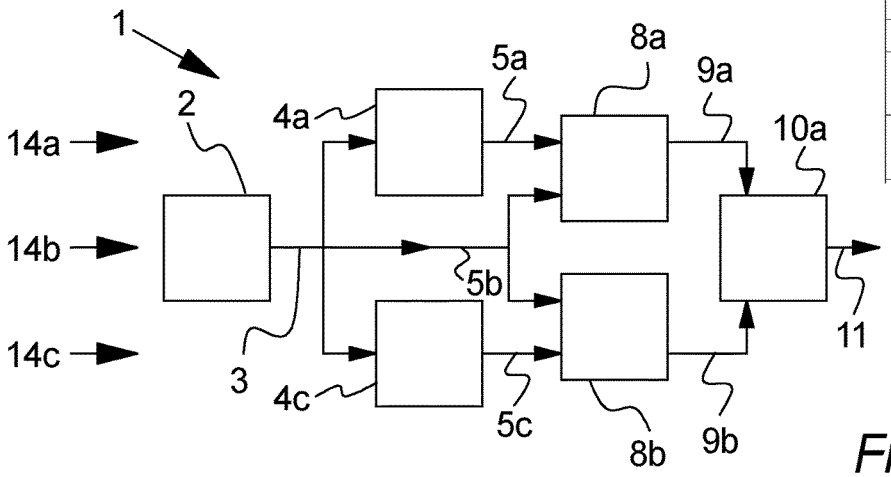
FIG. 4 illustrates an embodiment of the invention based on two analysis audio filters and three analysis audio channels.

FIG. 4 illustrates an embodiment of the invention based on two analysis audio filters 4*a*, 4*c* and three analysis audio channels 14*a*, 14*b*, 14*c*.

An input audio signal 3 from an audio signal input 2 is supplied to all three analysis audio channels 14*a*, 14*b*, 14*c*. A first analysis audio channel 14*a* has a first filtering unit 4*a* which filters the input audio signal 3 to establish a first analysis audio signal 5*a*. In a second analysis audio channel 14*b*, the input audio signal serves as the second analysis audio signal Finally, a third analysis audio channel 14*c* has a third filtering unit 4*c* which filters the input audio signal to establish a third analysis audio signal Sc.

A particular filtering unit may also be referred to as a filtering unit of a particular analysis audio channel or of a particular audio signal. For example, the third filtering unit 5*c* may also be referred to as a filtering unit of the third analysis audio channel 14*c* or a filtering unit of the third analysis audio signal 5*c*.

In the embodiment, the first analysis audio signal 5*a* and the second analysis audio signal are supplied to a first energy level comparator 8*a* which compares the signals to obtain a first energy level contrast 9*a*. In addition, the second analysis audio signal and the third analysis audio signal are supplied to a second energy level comparator 8*b* which compares the signals to obtain a second energy level contrast 9*b*. Obtaining a second energy level contrast 9*b* may supplement obtaining a first energy level contrast 9*a*. The second energy level contrast may for example have a different frequency range in which it is suitable for determining a representation of the dominant tone.

Both the first energy level contrast 9*a* and the second energy level contrast 9*b* are supplied to a frequency mapping unit 10*a*, which is able to determine a representation of the prominent tone 11 based on the contrasts 9*a*, 9*b*. The frequency mapping unit may for example apply a higher-dimensional lookup table to convert the contrasts 9*a*, 9*b* to a representation of the prominent tone 11.

Figure 5:
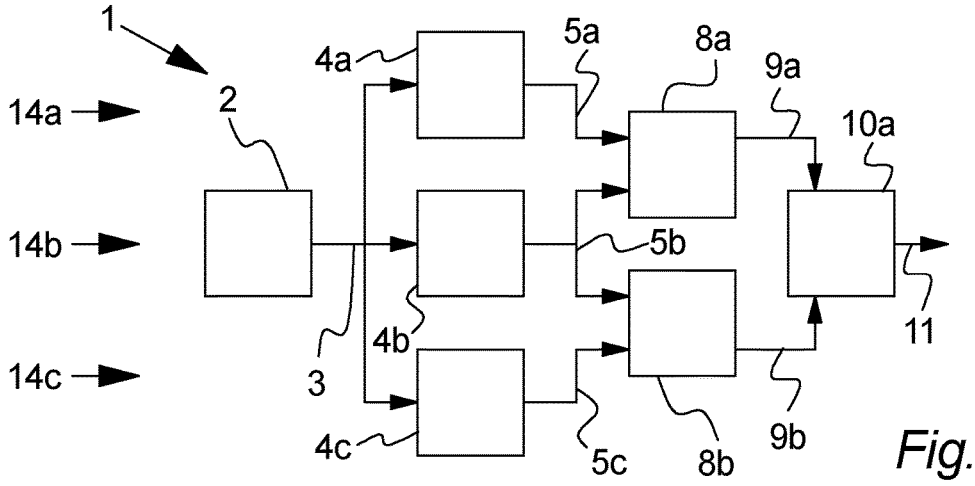
FIG. 5 illustrates an embodiment of the invention based on three analysis filters and two energy level contrasts.

FIG. 5 illustrates an embodiment of the invention based on three analysis filters 4*a*, 4*b*, 4*c* and two energy level contrasts. This embodiment is substantially similar to the embodiment of FIG. 4. However, the embodiment of FIG. 5 further comprises a second filtering unit. Thus, the second analysis audio channel 14*b* comprises the second filtering unit 4*b* which filters the input audio signal 3 to establish a second analysis audio signal 5*b*. Once the first analysis audio signal 5*a*, the second analysis audio signal 5*b*, and the third analysis audio signal 5*c* has been established, these signals are processed by two energy level comparators 8*a*, 8*b* to obtain two energy level contrasts 9*a*, 9*b*, which in turn is supplied to a frequency mapping unit to determine a representation of the prominent tone 11.

Figure 6:
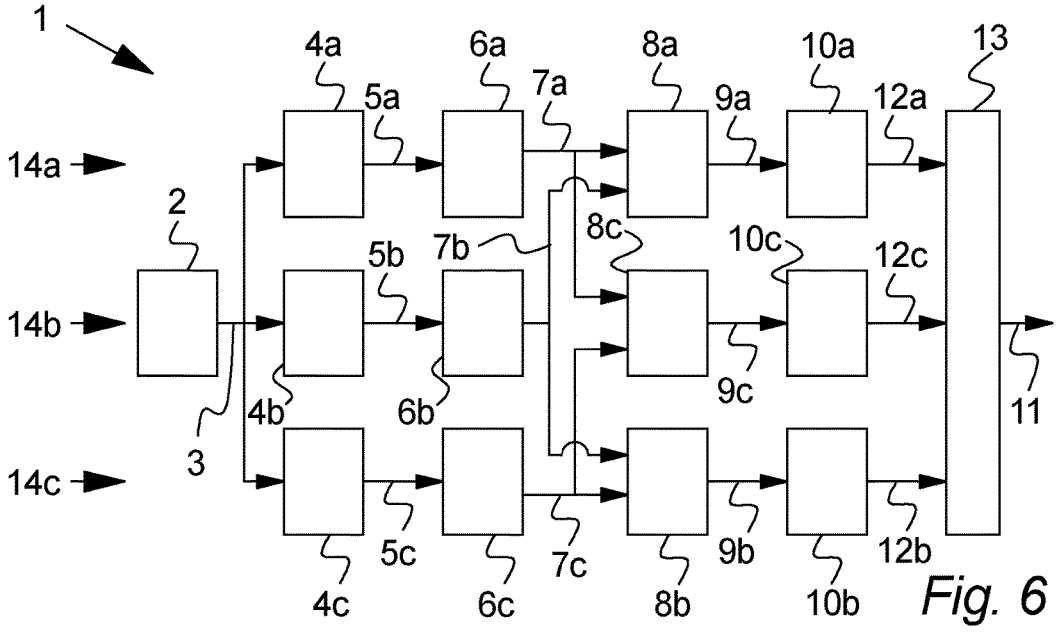
FIG. 6 illustrates an embodiment of the invention based on three analysis filters, three energy level contrasts, and a weighted averaging unit.

FIG. 6 illustrates an embodiment of the invention based on three analysis filters 4*a*, 4*b*, 4*c*, three energy level contrasts 9*a*, 9*b*, 9*c*, and a weighted averaging unit 13.

Three analysis audio signals 5*a*, 5*b*, 5*c* are established by supplying the input audio signal 3 to three separate filtering units 4*a*, 4*b*, 4*c*. Subsequently, the first analysis audio signal 5*a*, the second analysis audio signal 5*b*, and the third analysis audio signal 5*c*, are respectively supplied to a first level detector 6*a*, a second level detector 6*b*, and a third level detector 6*c* to respectively detect a first energy level 7*a*, a second energy level 7*b*, and a third energy level 7*c*.

The first energy level 7*a* and the second energy level 7*b* are compared in a first energy level comparator 8*a* to obtain a first energy level contrast 9*a*, the second energy level 7*b* and the third energy level 7*c* are compared in a second energy level comparator 8*b* to obtain a second energy level contrast 9*b*, and the first energy level 7*a* and the third energy level 7*c* are compared in a third energy level comparator 8*c* to obtain a third energy level contrast 9*c*.

Each of the three separate energy level contrasts 9*a*, 9*b*, 9*c* is supplied to a separate frequency mapping unit 10*a*, 10*b*, 10*c*. Consequently, the first energy level contrast 9*a* is converted by a first frequency mapping unit 10*a* into a first tentative frequency 12*a*, the second energy level contrast 9*b* is converted by a second frequency mapping unit 10*b* into a second tentative frequency 12*b*, and the third energy level contrast 9*c* is converted by a third frequency mapping unit 10*c* into a third tentative frequency 12*c*.

Each of the three frequency mapping units 10*a*, 10*b*, 10*c* may for example apply a contrast-to-frequency mapping function. Preferably, a given contrast-to-frequency mapping function may at least partly match the combined frequency dependence of the filter units upon which their input is based.

The three tentative frequencies 12*a*, 12*b*, 12*c* are all supplied to a weighted averaging unit, which is arranged to determine a weighted average of the three tentative frequencies. The weights of the weighted average may for example depend on the inputted tentative frequencies 12*a*, 12*b*, 12*c*. The representation of the prominent tone 11 may then be established based on the weighted average.

By having three tentative frequencies and a weighted average, it may be possible to improve precision, accuracy, or a frequency range in which the method is applicable.

Figure 7A:
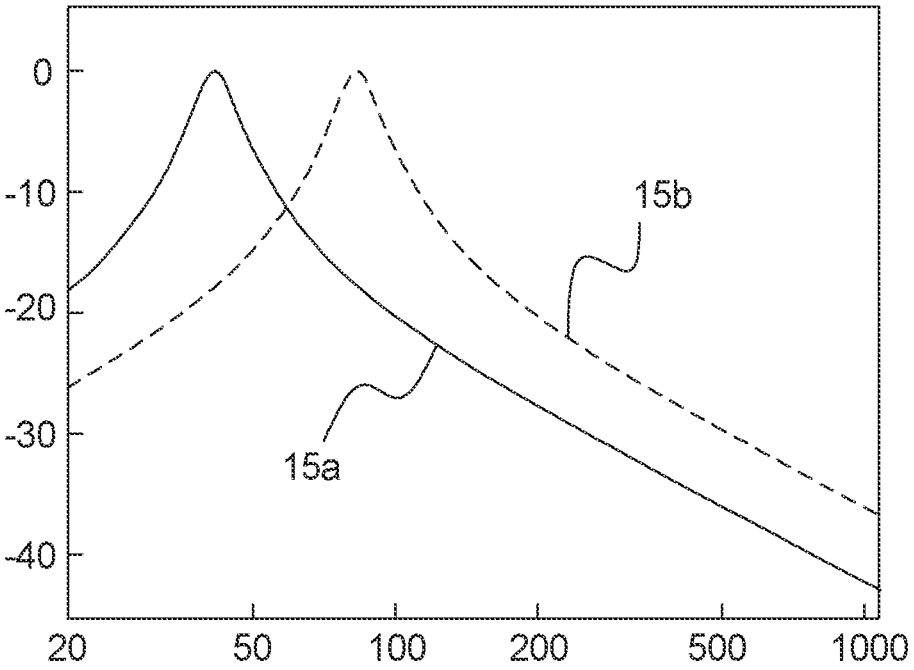
FIG. 7*a-b* illustrate a visual representation of two analysis audio filters and an associated representation of a relative attenuation.
Figure 7B:
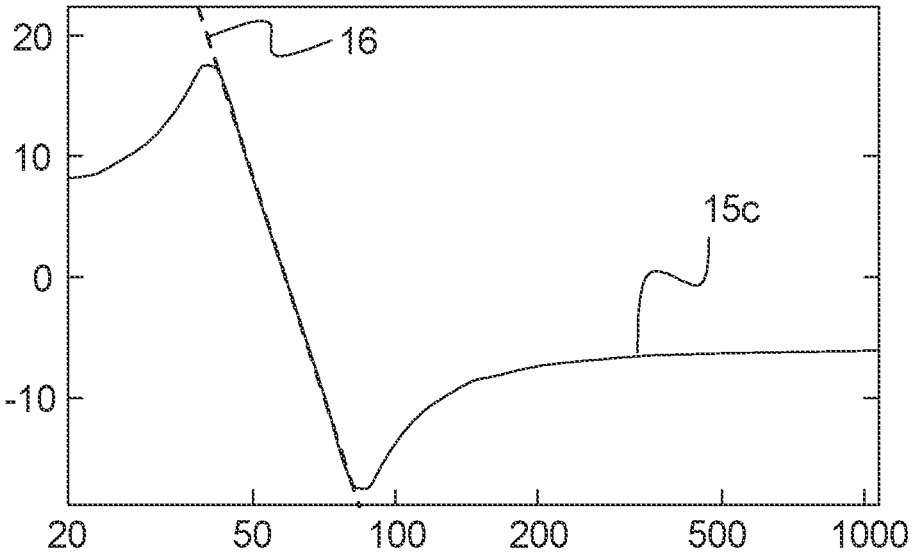

FIGS. 7*a-b* illustrate a visual representation of two analysis audio filters and an associated representation of a relative attenuation. As in FIG. 1*b*, the horizontal axes are frequency axes in units of Hz, while the vertical axes are energy level axes in units of dB. In contrast to FIG. 1*b*, the visual representation in FIG. 7*a* corresponds to two (not one) analysis audio filters, for example as implemented as first and second filtering units in the embodiment illustrated in FIG. 2. In FIG. 7*a*, both frequency representations of energy level attenuation 15*a*, 15*b* correspond to bandpass filters with respective center filter frequencies of approximately 41 Hz and 82 Hz.

The relative attenuation that the two filters may apply to an input audio signal comprising a prominent tone is illustrated as a frequency representation 15*c* in FIG. 7*b*. Below approximately 58 Hz, the relative attenuation is larger than 0, and above, the relative attenuation is below 0 dB. This reflects that the first frequency representation 15*a* lies higher on the attenuation axis than the second one 15*b* below this frequency and vice versa.

The relative attenuation may typically for various embodiments for example be basis for the energy level contrast. In an approximate frequency range determined by the center filter frequencies, the frequency representation 15*c* displays a linear slope. This linear slope may be used to convert an energy level contrast into a representation of the prominent tone using a contrast-to-frequency mapping function 16. In this exemplary illustration, the mapping function 16 is simply a straight line (on a non-linear scale, however). Thus, for example, a relative attenuation of approximately 8 dB may be converted by the mapping function 16 into a frequency of 50 Hz.

Note that this exemplary mapping function 16 is not an accurate representation of the frequency representation of the relative energy level attenuation 15*c* outside the filter center frequencies. The approximate range determined by the two center filter frequencies do thus constitute a valid frequency band.

In other embodiments, one or more mapping functions may be utilized to also obtain an accurate representation of the prominent tone outside the filter center frequencies of the filter units/analysis audio filters.

Figure 8A:
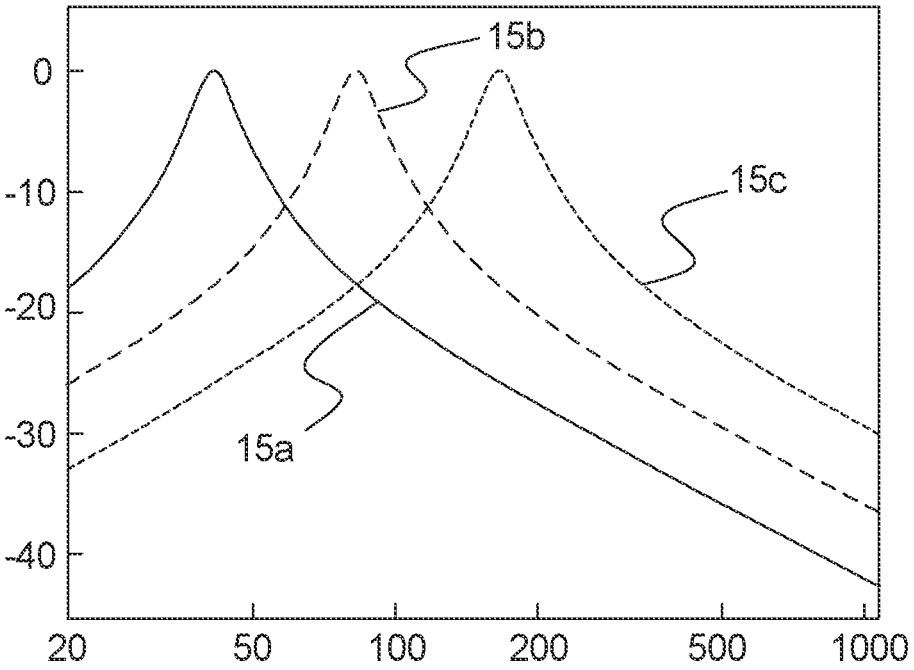
FIGS. 8*a-b* illustrate a visual representation of three analysis audio filters and two representations of a relative attenuation.
Figure 8B:
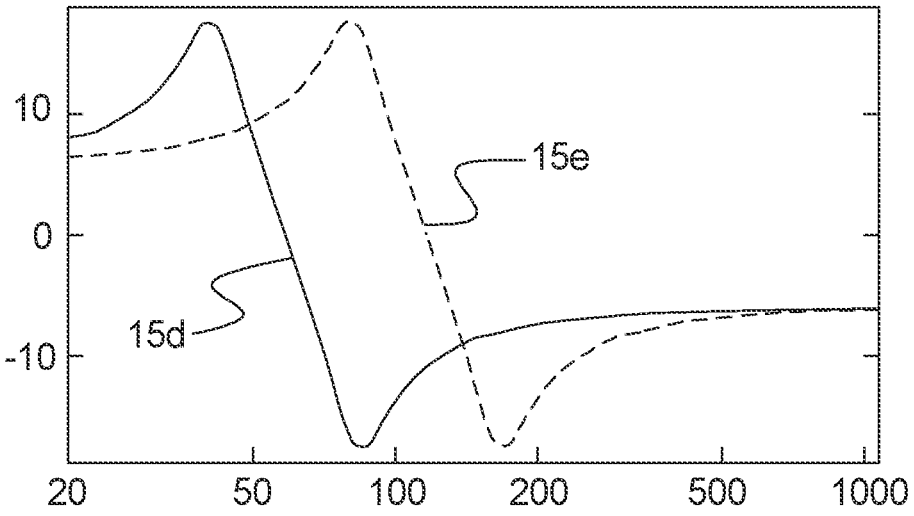

FIGS. 8*a-b* illustrate a visual representation of three analysis audio filters and two representations of a relative attenuation. FIG. 8*a* is similar to FIG. 7*a*, except that the visual representation of FIG. 8*a* corresponds to three filtering units, for example as implemented as first, second, and third filtering units in the embodiment illustrated in FIG. 5. In FIG. 8*a*, the three frequency representations of energy level attenuation 15*a*, 15*b*, 15*c* correspond to bandpass filters with respective center filter frequencies of approximately 41 Hz, 82 Hz, and 165 Hz.

In FIG. 8*b*, a first relative attenuation 15*d* corresponding to the difference in attenuation that the first and second frequency representations of energy level attenuation 15*a*, 15*b* applies is illustrated. Furthermore, a second relative attenuation 15*e* corresponding to the difference in attenuation that the second and third frequency representations of energy level attenuation 15*a*, 15*b* applies is illustrated. The first 15*d* and second representation 15*e* in FIG. 8*b* each have a steep slope in a separate frequency regime. Thus, a first pair of filters, corresponding to the first 15*a* and second representation 15*b* in FIG. 8*a*, may provide an accurate measure of the frequency of the prominent tone in a first frequency regime, whereas a second pair of filters, corresponding to the second 15*b* and third representation 15*c* in FIG. 8*a*, may provide an accurate measure of the frequency of the prominent tone in a second frequency regime. These different optimal frequency ranges may be combined, e.g., by the frequency-mapping unit or through a weighted average.

FIGS. 8*a*-8*b* can also be used to explain one approach to select audio analysis signals for further processing to obtain a representation of the prominent frequency. For example, based on the exemplary frequency representations 15*a-e*, only the first and the second frequency representations of energy level attenuation 15*a*, 15*b* are necessary to obtain a prominent tone in the frequency range from approximately 41 Hz to 82 Hz, while the third frequency representation 15*c* can be omitted. Similarly, only the second and the third frequency representations of energy level attenuation 15*b*, 15*c* are necessary to obtain a prominent tone in the frequency range from approximately 42 Hz to 165 Hz, while the first frequency representation 15*a* can be omitted. Determining which frequency range is correct and hence what analysis audio signals and energy level contrast to use can be performed simply by a comparison of energy levels of the analysis audio signals. For example, if the energy level of the first analysis audio signal, which is visualized by the first frequency representation 15*a*, is larger than the energy level of the third analysis audio signal, which is visualized by the third frequency representation 15*c*, then the relevant frequency range is below 82 Hz, and processing may be performed accordingly. Similarly, if the energy level of the first analysis audio signal is lower than the energy level of the first analysis audio signal, then the frequency range is above 82 Hz.

Figure 9A:
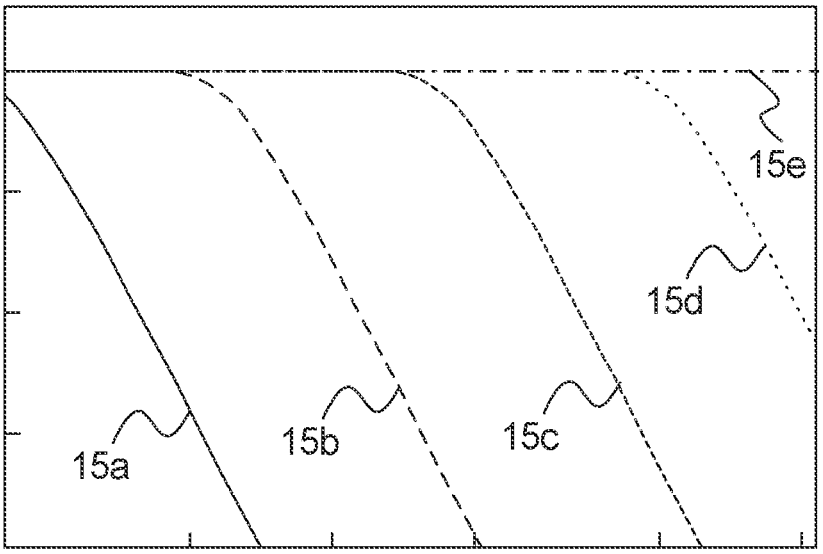
FIGS. 9*a-c* illustrate visual representations of various other analysis audio filter combinations.
Figure 9B:
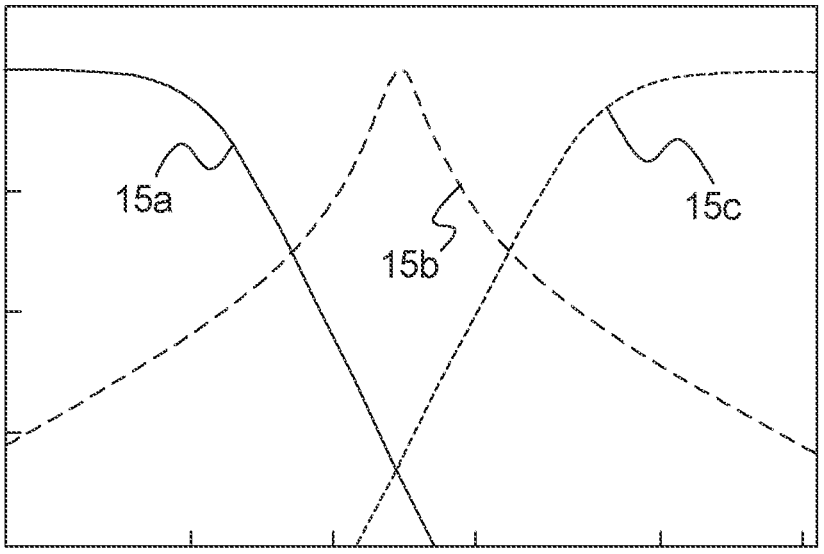
Figure 9C:
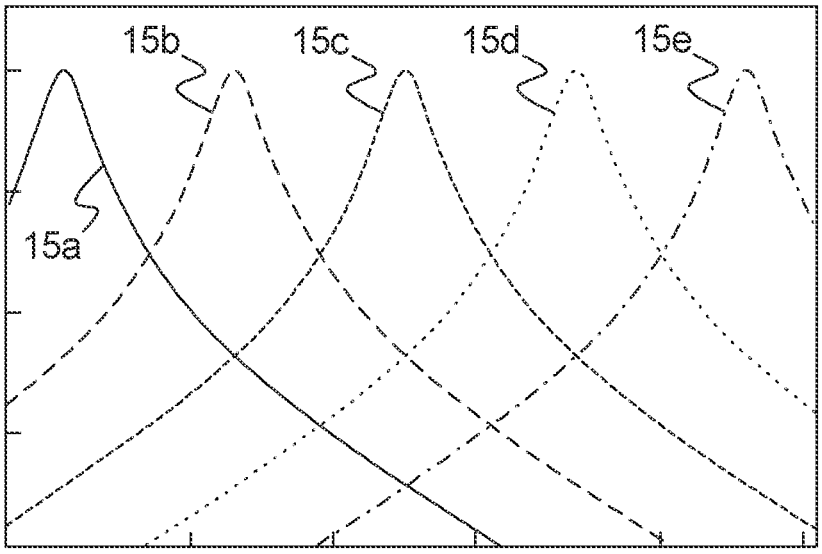

FIGS. 9*a-c* illustrate visual representations of various other analysis audio filter combinations. Each of the subfigures illustrate the representations on a horizontal axis which is an arbitrary frequency axis and a vertical axis which is an arbitrary energy level axis.

FIG. 9*a* illustrates using a plurality of low-pass filters in embodiments of the invention. Each individual filter may, in combination with another filter of higher cutoff frequency, be used to determine a representation of a prominent tone in a frequency range. For example, in a manner similar to the one described in relation to FIGS. 1*a-b*. By having a plurality of low-pass filters, instead of a single one, it is possible to combine the individual frequency ranges to cover any arbitrary range of frequencies. For example, a first filter illustrated as the leftmost representation 15*a* may, in combination with any of the other filters illustrated as representations 15*b*-15*e* with higher cutoff frequency, cover a first frequency range. Then, a second filter illustrated as the next representation 15*b* may, in combination with any of the other filters illustrated as representations 15*c*-15*e* with higher cutoff frequency, cover a next frequency range, etc.

For example, in an embodiment of the invention, at least five separate low-pass filters are implemented with cut-off frequencies 20 Hz, 100 Hz, 500 Hz, 2500 Hz, and 12500 Hz. Such filters may for example have frequency dependencies as visualized in FIG. 9*a* by representations 15*a*, 15*b*, 15*c*, 15*d*, and 15*e*. The first filter represented by the first representation 15*a* may in combination with the third filter represented by the third representation 15*c* be used to cover a frequency range from 20 Hz to 100 Hz. The second filter represented by the second representation 15*b* may in combination with the fourth filter represented by the third representation 15*d* be used to cover the frequency range from 100 Hz to 500 Hz, etc. Such embodiments may optionally also be based on an unfiltered input audio signal for use in a comparison of analysis audio signals.

In other embodiments, a similar principle may be implemented utilizing high-pass filters instead of low-pass filters.

FIG. 9*b* illustrates that low-pass 15*a*, bandpass 15*b*, and high-pass 15*c* filters may be combined in embodiments of the invention.

FIG. 9*c* illustrates how a plurality of bandpass filters can also be combined to cover any arbitrary range of frequencies.

In the following, various embodiments of the invention are presented without reference to particular figures.

In an embodiment of the invention, said first analysis audio signal is established by applying said analysis audio filter to said input audio signal.

In an embodiment of the invention, said second analysis audio signal is said input audio signal.

In an embodiment of the invention, said method comprises a step of recording said input audio signal via an input microphone.

Recording the input audio signal via an input microphone allows live analysis which is advantageous.

In an embodiment of the invention, said method comprises a step of providing said input audio signal.

Providing the input audio signal is not restricted to any particular means. It may for example be provided via data storage, a wired connection, a wireless connection, an input microphone etc.

In an embodiment of the invention, said input audio signal is at least partly dominated by said prominent tone.

Having an input audio signal which is at least partly dominated by said prominent tone may improve precision or accuracy of the representation of the prominent tone, which is advantageous.

In an embodiment of the invention, said prominent tone has a power level which is larger than a power level threshold in comparison with a power level of said input audio signal.

In an embodiment of the invention, said power level threshold is at least 1 dB, for example at least 3 dB, for example at least 6 dB, for example at least 10 dB, such as at least 20 dB.

A power level threshold may be understood as a minimal power level which the prominent tone should have before the method can be successfully applied, for some embodiments. The power level threshold may be defined in relation to the power level of the input audio signal, e.g., an average power level of the input audio signal, or power level of particular frequency components of the input audio signal. Such particular frequency components may for example be frequency components within a certain frequency analysis window in which the method is applied.

For example, in an embodiment of the invention, the power level threshold is 6 dB. If the input audio signal has a power level of −10 dB, the prominent tone should have a power level −4 dB or larger before the method can successfully find an accurate representation of the prominent frequency.

Restricting the prominent tone to a particular power level is advantageous, since it minimizes the risk of an inaccurate representation of the prominent frequency being determined.

In an embodiment of the invention, said representation of said prominent tone is a frequency representation of said prominent tone.

A frequency representation allows the frequency of the prominent tone to be utilized in further analysis, or to be provided to a user, which is advantageous.

In an embodiment of the invention, said analysis audio filter is a first analysis audio filter, wherein said first analysis audio signal is established by applying said first analysis audio filter to said input audio signal, wherein said second analysis audio signal is established by applying a second analysis audio filter to said input audio signal, wherein said first analysis filter and said second analysis filter are different.

Using two different filters allows the analysis to be tailored in detail which is advantageous. For example, the extent of an optimal frequency range may be increased, or the precision or accuracy may be improved.

In an embodiment of the invention, said representation of said prominent tone is provided to a user.

The representation may for example be provided to the user visually, e.g., via an electronic visual display, one or more LEDs, or one or more seven-segment or other displays. This allows the user to act upon the determined representation, which is advantageous. The representation may be provided in real time, or with delay.

In an embodiment of the invention, said audio input signal is based on sound from a musical instrument, wherein said prominent tone is associated with a musical note of said instrument.

Detecting a prominent tone associated with a musical note may for example be part of the act of tuning a musical instrument or analyzing an audio signal.

In an embodiment of the invention, said prominent tone is associated with audio feedback.

Audio feedback may for example occur when a sound output of a loudspeaker depends on sound recorded by a nearby microphone. Here, a signal received by the microphone may be amplified and passed to the loudspeaker which in turn outputs an amplified sound which the microphone can then receive again, thus constituting a feedback loop. Such audio feedback may typically be dominated by a single prominent tone, which the method of the invention may be suitable to identify.

In an embodiment of the invention, said step of comparing said first analysis audio signal and said second analysis audio signal comprises comparing a first energy level and a second energy level to obtain said energy level contrast, wherein said first energy level is based on said first analysis audio signal and said second energy level is based on said second analysis audio signal.

Basing the comparison on energy levels may improve or simplify the comparison, which is advantageous.

In an embodiment of the invention, said method comprises a step of measuring said first analysis audio signal to detect said first energy level and a step of measuring said second analysis audio signal to detect said second energy level.

Measuring an analysis audio signal to detect its energy level is a straightforward approach to determine the energy level and is thus advantageous due to simplicity. Such a measurement may for example be performed by a separate process or unit, e.g., a level detector. A measurement may also be performed as an integrated part of comparing the first and the second analysis audio signals.

In an embodiment of the invention, said step of comparing said first energy level and said second energy level comprises subtracting said first energy level from said second energy level to obtain said energy level contrast.

In an embodiment of the invention, said step of comparing said first energy level and said second energy level comprises calculating a ratio between said first energy level and said second energy level to obtain said energy level contrast.

Subtraction and calculation of a ratio are two exemplary approaches to compare energy levels, which are advantageous due to their simplicity.

In an embodiment of the invention, said contrast-to-frequency mapping function converts said energy level contrast by said contrast-to-frequency mapping function into said prominent tone.

In an embodiment of the invention, said contrast-to-frequency mapping function is a lookup table.

In an embodiment of the invention, said contrast-to-frequency mapping function is a mathematical function.

Both a lookup table and a mathematical function are easy to implement and require limited computational power, which is advantageous.

Other contrast-to-frequency mapping functions, e.g., a second or a third contrast-to-frequency mapping function, may also, for example, be based on lookup tables and/or mathematical functions.

A mathematical function may for example be a linear function or a non-linear function. It may be a piecewise mathematical function.

In an embodiment of the invention, said analysis audio filter has a filter center frequency.

For a bandpass filter, the filter center frequency may for example be understood as the frequency of the center of the bandpass filter and/or the frequency at which the attenuation/gain of the filter has an extrema point. For a low-pass and high-pass filters, the filter center frequency may for example be understood as the cutoff frequency of that filter. A cutoff frequency may for example be defined by as the frequency at which the filter attenuates an input signal by 3 dB.

In an embodiment of the invention, said analysis audio filter has a quality factor.

In an embodiment of the invention, said first analysis audio filter and said second analysis audio filter each has a filter center frequency, wherein a frequency ratio of said filter center frequency of said second analysis audio filter and said filter center frequency of said first analysis audio filter is from 1 to 1000, for example from 1.1 to 100, for example from 1.5 to 50, for example from 2 to 20, such as 10.

A filter center frequency may for example be a center frequency of a bandpass filter, or a cutoff frequency of a high-pass or low-pass filter.

Having distinct filter center frequencies allows audio analysis based on these frequencies, which is advantageous.

In an exemplary embodiment of the invention, the first analysis filter has a filter center frequency of 20.60 Hz, and the second analysis filter has a filter center frequency of 164.8 Hz. The frequency ratio is thus 8.

Having a specified frequency ratio of the filter center frequencies of the analysis audio filters may provide a certain optimal frequency range for the method, which is advantageous.

Alternatively, in some embodiments of the invention, the first and the second analysis audio filters have the same filter center frequency, but different quality factors, or they may be different kinds of filters.

In an embodiment of the invention, said first analysis audio filter and said second analysis audio filter each has a filter quality factor.

The filter quality factors of different analysis audio filters may be the same, or they may be different.

In an embodiment of the invention, said quality factor of any of said first analysis audio filter and said second analysis audio filter is from 0.01 to 100, for example from 0.1 to 10, such as 2 or 5.

In an embodiment of the invention, said method is associated with a valid frequency band, wherein a frequency error of said representation of said prominent tone is smaller inside said valid frequency band than outside said valid frequency band.

A frequency error may for example be inversely related to an accuracy and/or a precision of the frequency. For example, a frequency representation of a prominent tone may differ from the actual frequency of the prominent tone, which may be parametrized by a frequency error.

Having a frequency band with a smaller frequency error is advantageous for providing a precise and/or accurate representation of the prominent tone.

In an embodiment of the invention, said valid frequency band is based on said filter center frequency of said first analysis audio filter and said filter center frequency of said second analysis audio filter.

Basing a valid frequency band on the filters is advantageous, since the properties of the filters may then be selected to determine the frequency error.

In an embodiment of the invention, said method comprises at least one auxiliary audio filter, which at least partly attenuates audio frequencies of said input audio signal outside said valid frequency band.

Some embodiments have a valid frequency band, in which a frequency error is reduced. In contrast, outside this valid frequency band, the frequency error may be greater. Thus, in some embodiments, the method may not be applicable for detecting a prominent tone outside the valid frequency band. Thus, implementing at least one auxiliary audio filter to attenuate audio frequencies outside the valid frequency band may reduce undesirable noise, which is advantageous. Such auxiliary audio filters may for example by high-pass or low-pass filters.

In an embodiment of the invention, said analysis audio filter is a bandpass filter.

In some embodiments, the second analysis audio filter is a bandpass filter.

In an embodiment of the invention, said analysis audio filter is a high-pass filter.

In an embodiment of the invention, said analysis audio filter is a low-pass filter.

In some embodiments of the invention, the second analysis audio filter is a high-pass or a low-pass filter.

In some embodiments of the inventions, the first analysis audio filter is a high-pass filter and the second analysis audio filter is a low-pass filter, or vice versa. In some embodiments of the inventions, the first analysis audio filter is a bandpass filter and the second analysis audio filter is a high-pass or a low-pass filter, or vice versa.

In an embodiment of the invention, said analysis audio filter is an all-pass filter.

In some embodiments of the invention, the second analysis audio filter is an all-pass filter.

An all-pass filter may be understood as a filter which applies a frequency dependent phase shift. In embodiments with an all-pass filter, the comparison of the first and the second analysis audio signals may thus involve estimating a relative phase shift between the two audio signals, and accordingly, the energy level contrast is indicative of this relative phase shift.

In an embodiment of the invention, said energy level contrast is a first energy level contrast, wherein said method further comprises the steps of: establishing a third analysis audio signal based on said input audio signal; and comparing said second analysis audio signal and said third analysis audio signal to obtain a second energy level contrast, wherein said representation of said prominent tone is further based on said second energy level contrast.

Introducing a third analysis audio signal may extend a valid frequency band, improve precision, or improve accuracy, which is advantageous.

In some embodiments of the invention, the first and the second energy level contrast may be obtained simultaneously. In some embodiments of the invention, only one of the first and the second energy level contrasts are obtained at a time. E.g., in one instance of performing the method, the first energy level contrast is obtained to determine the representation of the prominent tone based on this first energy level contrast. In a later instance of performing the method, the second energy level contrast is obtained to determine the representation of the prominent tone based on this second energy level contrast. This may for example occur if the different energy level contrasts are used to determine the representation of the prominent tone in different frequency ranges, while the actual frequency of the prominent tone is changing.

In an embodiment of the invention, said third analysis audio signal is established by applying a third analysis audio filter to said input audio signal.

The third analysis signal may for example be established by filtering the input audio signal, or it may for example be the input audio signal. Applying a filter allows flexibility in the analysis of the input audio signal and in the determination of the representation of the prominent tone, which is advantageous.

In an embodiment of the invention, said contrast-to-frequency mapping function is a first contrast-to-frequency mapping function, wherein said first contrast-to-frequency mapping function converts said first energy level contrast into a first tentative frequency, wherein a second contrast-to-frequency mapping function converts said second energy level contrast into a second tentative frequency, wherein said representation of said prominent tone is based on said first tentative frequency and said second tentative frequency.

Providing two mapping functions may improve precision, accuracy, or a valid frequency band, which is advantageous.

In an embodiment of the invention, said method further comprises a step of comparing said first analysis audio signal and said third analysis audio signal to obtain a third energy level contrast, wherein said representation of said prominent tone is based on said third energy level contrast.

Obtaining several energy level contrasts may improve precision, accuracy, or a valid frequency band, which is advantageous.

In an embodiment of the invention, a third contrast-to-frequency mapping function converts said third energy level contrast into a third tentative frequency, wherein said representation of said prominent tone is based on said third tentative frequency.

Providing three or more mapping functions may improve precision, accuracy, or a valid frequency band, which is advantageous.

In an embodiment of the invention, said step of comparing said second analysis audio signal and said third analysis audio signal comprises comparing said second energy level and a third energy level to obtain said second energy level contrast, wherein said third energy level is based on said third analysis audio signal.

In an embodiment of the invention, said step of comparing said first analysis audio signal and said third analysis audio signal comprises comparing said first energy level and said third energy level to obtain said third energy level contrast.

In an embodiment of the invention, said method further comprises a step of measuring said third analysis audio signal to detect said third energy level.

In an embodiment of the invention, said representation of said prominent tone is based on a weighted average of said first tentative frequency and said second tentative frequency.

In an embodiment of the invention, said representation of said prominent tone is based on a weighted average of said first tentative frequency, said second tentative frequency, and said third tentative frequency.

A weighted average allows combining several tentative frequencies into a single representation of a prominent tone which may improve precision, accuracy, or a valid frequency band, which is advantageous.

A weighted average may be based on two, three, or more than three tentative frequencies.

The weights used by the weighted average may be flat, or depend frequency or energy level contrast. Such a dependence may for example vary in a continuous manner and/or in a stepwise manner. The weights may for example be piecewise mathematical functions or look-up tables.

In an embodiment of the invention, said method comprises a step of establishing a plurality of analysis audio signals by separately applying a plurality of analysis audio filters to said input audio signal, wherein said plurality of analysis audio signals comprises said first analysis audio signal and said second analysis audio signal, wherein said plurality of analysis audio filters comprises said analysis audio filter, wherein said step of determining said representation of said prominent tone is based on said plurality of analysis audio signals.

For example, an analysis audio signal of the plurality of analysis audio signals may be established by applying an analysis audio filter of the plurality of analysis audio filters to the input audio signal. Each analysis audio filter may thus be used for establishing a separate analysis audio signal.

Embodiments of the invention may for example comprise at least three analysis audio signals, for example at least four analysis audio signals, for example at least five analysis audio signals, such as at least six analysis audio signals.

Embodiments of the invention may for example comprise at least three analysis audio filters, for example at least four analysis audio filters, for example at least five analysis audio filters, such as at least six analysis audio filters.

The number of analysis audio filters and analysis audio signals may or may not be the same.

The established plurality of analysis audio signals may be used for determining a representation of the prominent tone. For example, one or more energy level contrasts may be stablished by comparing any energy levels of the analysis audio signals, and the representation of the prominent tone may then be based on converting one or more of these one or more energy level contrasts to one or more tentative frequencies upon which the representation of the prominent tone is based.

Establishing a plurality of analysis audio signals by separately applying a plurality of analysis audio filters to said input audio signal is advantageous since it may improve precision, accuracy, or a range of a valid frequency band.

An aspect of the invention relates to an audio processing unit for detecting a prominent tone of an input audio signal, said audio processing unit comprising: an audio signal input for providing said input audio signal; a filtering unit communicatively coupled to said audio signal input for applying an audio analysis filter to said input audio signal; an energy level comparator communicatively coupled to said audio signal input via a first analysis audio channel and a second analysis audio channel, wherein an analysis audio channel of said first analysis audio channel and said second analysis audio channel comprises said filtering unit, wherein said energy level comparator is arranged to output an energy level contrast; and a frequency mapping unit communicatively coupled to said energy level comparator and arranged to output a representation of said prominent tone by converting said energy level contrast by a contrast-to-frequency mapping function.

An audio signal input may be any type of input, e.g., based on a wired connection, a wireless connection, a microphone, or a data storage for providing the input audio signal. As such, the audio signal input does not necessarily have a physical connector.

In an embodiment of the invention, said energy level contrast is based on input from said first analysis audio channel and said second analysis audio channel.

In an embodiment of the invention, said filtering unit is a first filtering unit, wherein said first analysis audio channel comprises said first filtering unit, wherein said second analysis audio channel comprises a second filtering unit, where said first filtering unit and said second filtering unit are different.

In an embodiment of the invention, said energy level comparator is arranged to compare an energy level of a first analysis audio signal of the first analysis audio channel and an energy level of a second analysis audio signal of the second analysis audio channel to obtain said energy level contrast.

In an embodiment of the invention, said filtering unit is arranged to apply a first audio filter to said input audio signal to generate a first analysis audio signal.

In an embodiment of the invention, said second filtering unit is arranged to apply a second audio filter to said input audio signal to generate a second analysis audio signal.

In an embodiment of the invention, said energy level comparator is communicatively coupled to said first filtering unit through a first level detector, wherein said energy level comparator is communicatively coupled to said second filtering unit through a second level detector.

In an embodiment of the invention, said first level detector is arranged to measure said first analysis audio signal to detect a first energy level and said second level detector is arranged to measure said second analysis audio signal to detect a second energy level.

In an embodiment of the invention, said frequency mapping unit is arranged to apply a contrast-to-frequency mapping function to said energy level contrast to output said representation of said prominent tone.

In an embodiment of the invention, said audio signal processing unit is at least partly based on a digital signal processer, wherein said digital signal processor comprises any of said audio signal input, said filtering unit, said energy level comparator, and said frequency mapping unit.

In some embodiments, the digital signal processor may further comprise any of the second filtering unit, the first level detector, and the second level detector.

An aspect of the invention relates to use of said audio processing unit to detect audio feedback, wherein said prominent tone is associated with said audio feedback.

Whenever audio feedback occurs, it may typically be considered a prominent tone of an input audio signal. Thus, an audio processing unit of the invention may advantageously be used to detect audio feedback.

An aspect of the invention relates to use of said audio processing unit to detect a musical tone of a musical instrument, wherein said prominent tone is associated with said musical tone.

Detecting a musical tone may for example be part of the act of tuning a musical instrument or analyzing an audio signal.

Whenever a musical instrument is tuned, a musical tone of the instrument may for example be basis for an input audio signal, and the musical tone may for example have a fundamental frequency which is to be tuned while serving as a prominent tone of the input audio signal.

Thus, an audio processing unit of the invention may advantageously be used to detect a musical tone.

Tuning may for example be a process of adjusting the pitch of one or many tones from musical instruments to establish certain frequencies of the tones or certain frequency intervals between these tones.

A musical instrument may be a string instrument such as a guitar or a piano.

In use to detect a musical tone, the input audio signal may for example be based on sound from the musical instrument. The sound may for example be recorded via an input microphone.

From the above, it is now clear that the invention relates to a method and a device for detecting a prominent tone of an input audio signal and provide a representation of that tone, e.g., its frequency as a digital or analogue representation. The invention is based on applying one or more frequency-dependent filters to the input audio signal to establish analysis audio signals. The energy of the analysis audio signals is frequency dependent due to the frequency dependency of the one or more applied audio filters. The relative energy between analysis audio signals may thus be directly related to the frequency of the prominent tone. The analysis audio signals are compared to obtain an energy level contrast, indicative of the relative energy of the signals. This energy level contrast may then be translated into a representation of the prominent tone by a contrast-to-frequency mapping function. The invention thus provides simple and generally applicable means of analysing an audio signal to provide a representation of a prominent tone of an input audio signal.

The invention has been exemplified above with the purpose of illustration rather than limitation with reference to specific examples of methods and embodiments. Details such as a specific method and system structures have been provided in order to understand embodiments of the invention. Note that detailed descriptions of well-known systems, devices, circuits, and methods have been omitted so as to not obscure the description of the invention with unnecessary details. It should be understood that the invention is not limited to the particular examples described above and a person skilled in the art can also implement the invention in other embodiments without these specific details. As such, the invention may be designed and altered in a multitude of varieties within the scope of the invention as specified in the claims.

LIST OF REFERENCE SIGNS

1 Audio processing unit
2 Audio signal input
3 Input audio signal
4*a-c* Filtering unit
5*a-c* Analysis audio signal
6*a-c* Level detector
7*a-c* Energy level
8*a-c* Energy level comparator
9*a-c* Energy level contrast
10*a-c* Frequency mapping unit
11 Representation of the prominent tone
12*a-c* Tentative frequency
13 Weighted averaging unit
14*a-c* Analysis audio channel
15*a-e* Frequency representation of energy level attenuation
16 Contrast-to-frequency mapping function
S1-S4 Method steps

The invention claimed is:

1. A method for detecting a prominent tone of an input audio signal, said method comprising:

establishing a first analysis audio signal based on said input audio signal, said first analysis audio signal being established by applying a first analysis audio filter to said input audio signal;

establishing a second analysis audio signal based on said input audio signal, said second analysis audio signal being established by applying a second analysis audio filter to said input audio signal, wherein said first analysis filter and said second analysis filter are different;

comparing said first analysis audio signal and said second analysis audio signal to obtain an energy level contrast; and determining a representation of said prominent tone by converting said energy level contrast by a contrast-to-frequency mapping function, wherein said first analysis audio filter and said second analysis audio filter both have a filter center frequency, wherein said method is associated with a valid frequency band, wherein a frequency error of said representation of said prominent tone is smaller inside said valid frequency band than outside said valid frequency band, and wherein said valid frequency band is based on said filter center frequency of said first analysis audio filter and said filter center frequency of said second analysis audio filter.

2. The method according to claim 1, further comprising inputting or recording said input audio signal via an input microphone.

3. The method according to claim 1, further comprising providing a representation of said prominent tone to a user.

4. The method according to claim 1, wherein said comparing said first analysis audio signal and said second analysis audio signal comprises comparing a first energy level and a second energy level to obtain said energy level contrast, and wherein said first energy level is based on said first analysis audio signal and said second energy level is based on said second analysis audio signal.

5. The method according to claim 4, further comprising measuring said first analysis audio signal to detect said first energy level and a step of measuring said second analysis audio signal to detect said second energy level.

6. The method according to claim 1, wherein a frequency ratio of said filter center frequency of said second analysis audio filter and said filter center frequency of said first analysis audio filter is from 1 to 1000.

7. The method according to claim 1, wherein a frequency ratio of said filter center frequency of said second analysis audio filter and said filter center frequency of said first analysis audio filter is from 1.1 to 100.

8. The method according to claim 1, wherein a frequency ratio of said filter center frequency of said second analysis audio filter and said filter center frequency of said first analysis audio filter is from 1.5 to 50.

9. The method according to claim 6, wherein said method is associated with a valid frequency band, and wherein a frequency error of said representation of said prominent tone is smaller inside said valid frequency band than outside said valid frequency band.

10. The method according to claim 9, wherein said valid frequency band is based on said filter center frequency of said first analysis audio filter and said filter center frequency of said second analysis audio filter.

11. The method according to claim 10, further comprising at least partly attenuating audio frequencies of said input audio signal outside said valid frequency band using at least one auxiliary audio filter.

12. The method according to claim 1, wherein said energy level contrast is a first energy level contrast, wherein said method further comprises:

establishing a third analysis audio signal based on said input audio signal; and comparing said second analysis audio signal and said third analysis audio signal to obtain a second energy level contrast, wherein said representation of said prominent tone is further based on said second energy level contrast.

13. The method according to claim 12, wherein said third analysis audio signal is established by applying a third analysis audio filter to said input audio signal.

14. The method according to claim 13, wherein said contrast-to-frequency mapping function is a first contrast-to-frequency mapping function, wherein said first contrast-to-frequency mapping function converts said first energy level contrast into a first tentative frequency, wherein a second contrast-to-frequency mapping function converts said second energy level contrast into a second tentative frequency, and wherein said representation of said prominent tone is based on said first tentative frequency and said second tentative frequency.

15. The method according to claim 14, further comprising comparing said first analysis audio signal and said third analysis audio signal to obtain a third energy level contrast, wherein said representation of said prominent tone is based on said third energy level contrast.

16. The method according to claim 15, wherein a third contrast-to-frequency mapping function converts said third energy level contrast into a third tentative frequency, and wherein said representation of said prominent tone is based on said third tentative frequency.

17. The method according to claim 14, wherein said representation of said prominent tone is based on a weighted average of said first tentative frequency and said second tentative frequency.

18. The method according to claim 1, further comprising establishing a plurality of analysis audio signals by separately applying a plurality of analysis audio filters to said input audio signal, wherein said plurality of analysis audio signals comprises said first analysis audio signal and said second analysis audio signal, wherein said plurality of analysis audio filters comprises said analysis audio filter, and wherein said determining said representation of said prominent tone is based on said plurality of analysis audio signals.

19. An audio processing unit for detecting a prominent tone of an input audio signal, said audio processing unit comprising:

an audio signal input for providing said input audio signal;

a filtering unit communicatively coupled to said audio signal input for applying a first and a second audio analysis filters to said input audio signal;

an energy level comparator communicatively coupled to said audio signal input via a first analysis audio channel and a second analysis audio channel, wherein an analysis audio channel of said first analysis audio channel and said second analysis audio channel comprises said filtering unit, wherein said energy level comparator is arranged to output an energy level contrast; and a frequency mapping unit communicatively coupled to said energy level comparator and arranged to output a representation of said prominent tone by converting said energy level contrast by a contrast-to-frequency mapping function, wherein said first analysis audio filter and said second analysis audio filter both have a filter center frequency, and wherein a valid frequency band is based on said filter center frequency of said first analysis audio filter and said filter center frequency of said second analysis audio filter.

* * * * *